United States Patent [19]

Tkach et al.

[11] 4,171,727

[45] Oct. 23, 1979

[54] REVERSIBLE, PERCUSSIVE DEVICE FOR GROUND PERFORATION

[75] Inventors: Khaim B. Tkach; Alexandr D. Kostylev; Vladimir M. Terin; Konstantin B. Skachkov; Alexei D. Terskov, all of Novosibirsk; Mikhail J. Bondar; Vladimir F. Drobyazko, both of Odessa, all of U.S.S.R.

[73] Assignee: Institut Gornogo Dela Sibirskogo Otdelenia Akademii Nauk S S S R, U.S.S.R.

[21] Appl. No.: 804,269

[22] Filed: Jun. 7, 1977

[30] Foreign Application Priority Data

Oct. 22, 1976 [SU] U.S.S.R. ..... 2416534[I]

[51] Int. Cl.[2] ..... E21B 11/02

[52] U.S. Cl. ..... 175/19; 173/91

[58] Field of Search ..... 175/19; 173/91

[56] References Cited

U.S. PATENT DOCUMENTS

| | | | |
|---|---|---|---|
| 3,727,701 | 4/1973 | Sudnishnikov et al. | 173/91 |
| 3,995,702 | 12/1976 | Klimashko | 173/91 |

FOREIGN PATENT DOCUMENTS

| | | | |
|---|---|---|---|
| 388121 | 6/1973 | U.S.S.R. | 173/91 |

*Primary Examiner*—Ernest R. Purser
*Assistant Examiner*—Richard E. Favreau
*Attorney, Agent, or Firm*—Robert E. Burns; Emmanuel J. Lobato; Bruce L. Adams

[57] ABSTRACT

A reversible ground perforating device powered by a gaseous medium under pressure, comprising a hollow cylindrical body with a pointed front end. The body accommodates a hammer adapted to reciprocate therein. A front power chamber of variable volume is formed by the hammer in the body. The rear end of the hammer has a cylindrical hollow which forms a rear power chamber of variable volume. The power chambers are interconnected by means of ports provided in the hammer. A stepped cylindrical barrel is located inside the cylindrical hollow in the hammer and coaxially therewith. The barrel is secured in the rear end of the body and the large-diameter portion of the barrel is arranged to interact with the hammer. The wall of the large-diameter portion of the barrel has ports. A spring-loaded stepped sleeve is mounted coaxially with the stepped barrel so that the large-diameter portion of the sleeve is adapted to cover the ports in the barrel. The space between the large-diameter portions of the sleeve and barrel forms an annular chamber. Holes are provided in the sleeve small-diameter portion interacting with the barrel small-diameter portion. A ring is flexedly mounted in the large-diameter portion of the barrel in the front end thereof and coaxially therewith. The space between the ring, the inner surface of the barrel and the outer surface of the sleeve forms an auxiliary annular chamber. The annular chamber is in communication with the source of a compressed gaseous medium during forward movement of the ground perforating device, whereas the auxiliary annular chamber is in communication with this source during reverse movement of the device.

3 Claims, 11 Drawing Figures

REVERSIBLE, PERCUSSIVE DEVICE FOR GROUND PERFORATION

BACKGROUND OF THE INVENTION

The present invention relates to construction engineering and has particular reference to reversible, percussive devices for ground perforation.

The invention can be used with particular advantage for perforating the ground by compaction thereof. It may also be advantageous to employ this invention in driving pipes into the ground, for example, when laying underground piping without trench excavation.

Ground perforating devices powered by a gaseous medium, for example air, under pressure are known in the art. These devices are mostly reversible, i.e. they can move forward to advance into the ground and can also move in reverse, out of the ground.

A known ground perforating device has a cylindrical body with a pointed front end. The cylindrical body accommodates a hammer adapted to reciprocate therein. The rear portion of the hammer has a hollow which accommodates a stepped sleeve secure in the cylindrical body by means of a screwed joint. The sleeve has two positions: one for forward movement and the other for reverse movement of the ground perforating device. Attached to the rear end of the sleeve is a hose for supplying a gaseous medium, for example, compressed air. The space between the outer surface of the hammer and the inner surface of the cylindrical body forms a front power chamber. The space in the rear end of the hammer between the interior surfaces thereof and the sleeve forms a rear power chamber. A port is provided in the hammer to permit intercommunication of the front and rear power chambers for the purpose of effecting the reciprocating motion of the hammer, said chambers being put in communication when the hammer is in the front portion of the cylindrical body.

The known ground perforating device under consideration operates by the action of compressed air supplied through the hose and sleeve into the front chamber. Forced by the air pressure, the hammer moves forward and, at the end of the stroke, strikes the front end of the cylindrical body. At this instant the compressed air passes from the rear chamber through the hammer port into the front chamber.

Inasmuch as the area of the hammer end face acted upon by the air pressure in the front chamber is larger than the area of the hammer end face acted upon the air pressure in the rear chamber, the force exerted on the hammer in the backward direction is greater than the force exerted thereon in the direction of forward travel. In consequence, the hammer moves backwards. When the hammer port becomes uncovered by the rear edge of the sleeve, the compressed air exhausts from the front chamber into the atmosphere. The air pressure in the front chamber drops below the air pressure in the rear chamber (which is equal to the supply pressure), the hammer is caused to move towards the front end of the cylindrical body, and the cycle commences over again.

For the ground perforating device to move in reverse, the sleeve is set in the rearmost position by rotating it by means of the air hose attached thereto.

With this setting of the sleeve, compressed air enters the rear chamber and periodically passes through the hammer port into the front chamber, thereby causing the hammer to reciprocate. However, in this case the hammer strikes the rear end of the cylindrical body and drives the perforating device back and out of the hole perforated by the forward motion.

The ground perforating device under consideration suffers from the disadvantage that in the case of a substantially long perforation it is difficult, if not impossible, to impart rotation to the sleeve through the air hose. Furthermore, the changeover from one direction of movement to the other takes too much time.

Also known in the art are ground perforating devices comprising a cylindrical body accommodating a hammer adapted to reciprocate therein. The rear end of the hammer is hollowed to accommodate a sleeve secured in the cylindrical body. The space between the outer walls of the hammer and the inner walls of the cylindrical body forms a front power chamber. The space between the walls of the hammer hollow and the end of the sleeve forms a rear power chamber. These chambers are interconnected by provision of a port in the hammer.

The sleeve has two circular projections between which are provided two longitudinal projections designed to limit axial movement of the sleeve and two recesses arranged to prevent the sleeve from rotation relative to the cylindrical body. The sleeve is installed in a hole in a guiding element which has two longitudinal grooves and a hole accommodating a spring-loaded retainer connected with a remote-control cable. The locking element of the retainer enters the sleeve recess for locking the sleeve in position. The longitudinal grooves are formed in the walls of the axial hole in the guiding element. The circular and longitudinal projections provide two locked positions of the sleeve, viz. one for forward movement and the other for reverse movement of the ground perforating device.

For the ground perforating device to move forward, the sleeve is positioned so that the hammer strikes the front end of the cylindrical body and practically at the same time compressed air is admitted into the front chamber. With this mode of operation, the hammer reciprocates, striking the front end of the cylindrical body.

To reverse the movement of the ground perforating device, the sleeve is to be set into the other extreme position. For the purpose the retainer remote-control cable is pulled by hand, whereby the locking element is disengaged from the recess in the sleeve. Thereafter, by rotating the air hose the sleeve is turned relative to the guiding element until the longitudinal projections on the sleeve are aligned with the grooves in the guiding element. By the action of the compressed air contained in the rear chamber the sleeve is moved away from the front end of the cylindrical body into the other position. To lock the sleeve in position, it is turned about the axis thereof by means of the air hose and thereafter the locking element is engaged by releasing the retainer remote-control cable.

With the sleeve in this position, the admission of compressed air into the front chamber is advanced and the exhaust of compressed air is retarded, as compared with the operation during the forward movement of the ground perforating device, whereby the hammer is caused to strike the rear end of the body, the ground perforating device moving in reverse.

The ground perforating device under discussion suffers from the disadvantage that the remote-control cable may become twisted with the air hose or caught on some object. Another disadvantage is that the turning of the air hose for effecting the reversal is difficult in case of long perforations. The aforementioned disadvantages hamper the operation of the ground perforating device in question.

Also known in the art is a ground perforating device comprising a cylindrical body accommodating a hammer adapted to reciprocate therein. The rear portion of the hammer has a hollow which accommodates a barrel secured in the cylindrical body. The space between the outer walls of the hammer and the inner walls of the cylindrical body forms a front power chamber. The space between the walls of the hammer hollow and the end of the barrel forms a rear power chamber. In order that reciprocating motion of the hammer may be effected, said chambers are interconnected by provision of a port in the hammer.

There is provided a sleeve, which sleeve is arranged to be turned relative to the barrel by provision of a shaped groove in the barrel into which fits a projection formed on the sleeve. The barrel has two rows of ports on the large-diameter portion thereof, whereas the sleeve has two rows of grooves on the large-diameter portion thereof, which grooves are arranged so that when the sleeve is turned relative to the barrel the sleeve walls cover one row of the barrel ports and uncover the other row. During forward movement of the ground perforating device the ports located nearer the front end of the cylindrical body are closed and the ports located nearer the rear end are open. Under these conditions compressed air enters the front chamber after the hammer ports have moved past the front edge of the barrel and the compressed air is exhausted through the open barrel ports.

When compressed air is supplied through the hose and the barrel into the rear chamber, the hammer moves toward the front end of the cylindrical body and, at the end of the forward stroke, strikes the body. At this instant compressed air passes from the rear chamber through the hammer ports into the front chamber. Due to the difference between the forces acting on the hammer from the front and rear chambers, the hammer is caused to move backwards. When the hammer ports have coincided with the barrel ports, the compressed air exhausts from the front chamber into the atmosphere.

The reversal of the ground perforating device is effected by shutting off the supply of compressed air. With the compressed air supply shut off, the sleeve is moved relative to the barrel by the action of a spring and is turned relative to the barrel by virtue of the shaped groove. Subsequently air to the ground perforating device is recommenced, the sleeve is turned some way further relative to the barrel, whereby the barrel ports nearer the front end of the cylindrical body are opened and the ports nearer the rear end are closed.

Under these conditions admission of compressed air into the front chamber is advanced and exhaust is retarded as compared with the forward mode of operation, owing to which the hammer strikes the rear end of the cylindrical body.

The ground perforating device under consideration suffers from the disadvantage that reversal is caused by any interruption of air supply, whether intentional or inadvertent, which is particularly inconvenient during the initial stage of perforation when compressed air supply is turned on and off over again for correcting the course of the perforating device.

SUMMARY OF THE INVENTION

It is an object of the present invention to eliminate the disadvantages of the ground perforating devices described above.

It is a further object of the present invention to provide a ground perforating device featuring operating convenience.

It is a still further object of the present invention to provide a ground perforating device featuring increased operating efficiency.

It is a still further object of the present invention to provide a ground perforating device featuring enhanced dependability of reversal control.

These and other objects are achieved by providing a device for perforating the ground by compaction thereof, said device being powered by a gaseous medium under pressure. According to the invention, the device comprises a hollow cylindrical body with a pointed front end. The cylindrical body accommodates a hammer adapted to reciprocate therein, the space between the cylindrical body and the hammer defines a front power chamber of variable volume. The rear portion of the hammer has a cylindrical hollow which forms a rear power chamber arranged to communicate with the front power chamber through ports provided in the hammer. The hammer strikes the cylindrical body while reciprocating therein under the action of a compressed gaseous medium supplied into the power chambers through a stepped barrel located inside the cylindrical hollow in the hammer coaxially therewith and secured to the rear end of the cylindrical body. The large-diameter portion of the barrel interacts with the hammer and has ports arranged to be covered by a spring-loaded hollow sleeve located coaxially with said stepped barrel. The space between the steps of the sleeve and barrel forms an annular chamber. The small-diameter portion of the sleeve interacting with the small-diameter portion of the barrel has holes connecting the annular chamber with the source of a compressed gaseous medium during forward movement of the ground perforating device. Fixedly mounted in the large-diameter portion of the barrel, at the front end thereof and coaxially therewith, is a ring. The space between the ring, the inner surface of the barrel and the outer surface of the sleeve forms an auxiliary annular chamber designed to be in communication with the source of a compressed gaseous medium during reverse movement of the ground perforating device.

This constructional arrangement provides for changing over from forward to reverse movement by pulling the air hose and enables the changeover from reverse to forward movement to be effected automatically by shutting off the compressed air supply.

It is desirable for the stepped sleeve and the stepped barrel to be provided with passages arranged to connect the auxiliary annular chamber with the atmosphere during forward movement of the ground perforating device.

This constructional arrangement provides for expelling from the auxiliary chamber and compressed air which may find way thereinto through clearance spaces between the contacting elements of the sleeve, barrel and ring, said air being exhausted into the atmosphere, whereby the difference between the air pressures in the power chambers is increased with consequent increase in the force retaining the sleeve in the extreme forward position.

It is further desirable that a circular groove be provided on the small-diameter portion of the sleeve, immediately behind the large-diameter portion thereof, on the side facing the rear end of the cylindrical body, for the annular chamber to communicate with the atmosphere during reverse movement of the ground perforating device.

This constructional arrangement provides for expelling from the annular chamber the compressed air which may find way thereinto through clearance spaces between the contacting elements of the sleeve and barrel, said air being exhausted into the atmosphere, whereby the difference between the air pressures in the power chambers is increased with consequent increase in the force retaining the sleeve in the extreme position.

It is still further desirable for the ring to be made of an elastic material in order to ensure a leakproof condition of the auxiliary chamber by providing a tight joint between the stepped sleeve and the ring in virtue of elastic deformation of the latter.

It is still further desirable for the ring made of an elastic material to be tapered on the side contacting the stepped sleeve, the mating face of the stepped sleeve being also tapered, whereby the tightness of the joint between the ring and the stepped sleeve is provided.

It is still further desirable that a shouldered ring made of a rigid material, for example, metal be provided between the contacting surfaces of the elastic ring and the stepped sleeve for the longevity of said surfaces to be increased.

It is still further desirable that, in order to simplify the construction of the ground perforating device, an insert be installed inside the stepped sleeve at the side thereof facing the hammer so that a passage be formed between the outer surface of said insert and the inner surface of the stepped sleeve, said passage connecting the auxiliary annular chamber with the atmosphere.

It is still further desirable that, in order to simplify the manufacture of the ground perforating device, reduce the weight thereof and thereby increase the longevity thereof, the insert be made of an elastic material, for example, rubber.

BRIEF DESCRIPTION OF THE DRAWINGS

Now the invention will be described in detail with reference to the accompanying drawings in which.

DESCRIPTION OF THE PREFERRED EMBODIMENTS

Figure 1:
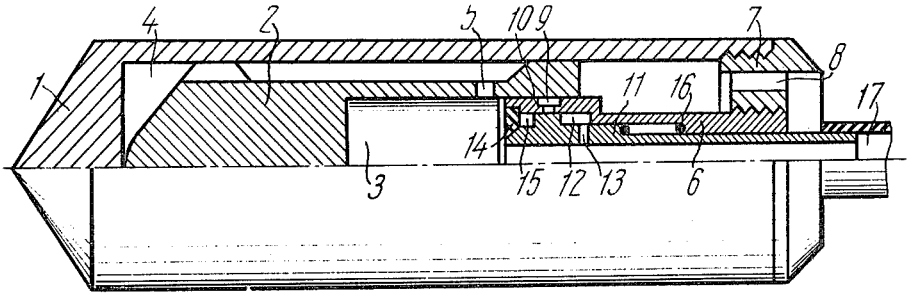
FIG. 1 is a longitudinal sectional view of a ground perforating device constituting the present invention, the parts being shown in their relative positions during forward movement of the device.

According to the invention, the reversible, precussive device for perforating the ground by compaction thereof comprises a hollow cylindrical body 1 (FIG. 1) with a pointed front or leading end designed for performing the perforating work in the ground. The body 1 accommodates a hammer 2 adapted to reciprocate therein. The rear portion of the hammer 2 has a cylindrical hollow which forms a rear power chamber 3. The space between the outer surface of the hammer 2 and the inner surface of the body 1 forms a front power chamber 4. The volume of the power chambers 3 and 4 varies as the hammer 2 reciprocates. The rear chamber 3 and the front chamber 4 are interconnected by provision of ports 5 in the hammer 2.

A stepped barrel 6 is located inside the hollow rear portion of the hammer 2 coaxially therewith and, consequently, with the body 1. The large-diameter portion of the barrel 6 fits inside the hammer 2, whereas the small-diameter portion of the barrel is attached to the rear end of the body 1 by means of a nut 7 which has a hole 8 for exhausting compressed air into the atmosphere. The large-diameter portion of the barrel 6 has ports 9 and a circular groove 10 formed on the barrel outside at the ports. The ports 9 in the barrel 6 are designed for compressed air to pass from the rear chamber 3 into the front chamber 4 during reverse movement of the ground perforating device.

Located inside the barrel 6 coaxially therewith is a hollow stepped sleeve 11. The space between the large-diameter portion of the sleeve 11 and the lage-diameter portion of the barrel 6 forms an annular chamber 12. A hole 13 is provided in the small-diameter portion of the sleeve 11 for the purpose of connecting the annular chamber 12 with the source of compressed air (not shown) during forward movement of the ground perforating device. A ring 14 is fixedly mounted in the large-diameter portion of the barrel 6 at the front end thereof and coaxially therewith. The space between the ring 14, the inner surface of the stepped barrel 6 and the outer surface of the stepped sleeve 11 forms an auxiliary annular chamber 15 designed to be in communication with the source of compressed air during reverse movement of the ground perforating device. A spring 16 is mounted between the stepped sleeve 11 and the stepped barrel 6. Attached to the stepped sleeve 11 is a hose 17 for supplying compressed air into the ground perforating device.

The ground perforating operation device described above operates as follows:

For the ground perforating device to move forward the stepped sleeve 11 is set in the extreme forward position by the action of the spring 16. With the stepped sleeve 11 in this position, the ports 9 in the stepped barrel 6 are closed by the large-diameter portion of the stepped sleeve 11 and the front end of the stepped sleeve 11 is in contact with the ring 14. FIG. 1 shows the hammer 2 in the extreme forward position during forward movement of the ground perforating device.

When compressed air is fed through the hose 17 into the rear chamber 3, it passes through the ports in the hammer 2 into the front chamber 4.

Inasmuch as the air pressures in the rear chamber 3 and the front chamber 4 are approximately equal, but the area of the end surface of the hammer 2 acted upon by the compressed air in the front chamber 4 is larger than the area of the end surface of the hammer 2 acted upon by the compressed air in the rear chamber 3, the force exerted on the hammer 2 in the front chamber 4 is greater than that in the rear chamber 3, due to which the hammer 2 is caused to move towards the rear end of the body 1. When the port 5 in the hammer 2 has been covered by the large-diameter portion of the stepped barrel 6, the supply of compressed air into the front chamber 4 is shut off. As the hammer 2 moves, the volume of the front chamber 4 increases and the compressed air contained therein expands. When the ports 5 in the hammer 2 have moved past the rear edge of the large-diameter portion of the stepped barrel 6, the front chamber 4 connects with the atmosphere through the holes 8 in the nut 7. The pressure of the air in the front chamber 4 becomes equal to the atmospheric pressure, there being no force exerted on the front end of the hammer 2. On the other hand, the rear chamber 3 is in constant communication with the source of compressed air and, therefore, the rear end of the hammer 2 is acted upon by the air pressure. Under the action of this air pressure the hammer 2 stops and then commences to move forward. At the end of the forward stroke the hammer 2 strikes the body 1 and approximately at the same time the port 5 in the hammer 2 goes past the front end of the stepped barrel 6, the compressed air passing from the rear chamber 3 through the port 5 into the front chamber 4. Now the hammer 2 starts moving back and the cycle commences over again.

As long as the ground perforating device operates in the mode of forward movement, the annular chamber 12 communicates through the hole 13 in the stepped sleeve 11 with the source of compressed air and therefore the air pressure in said annular chamber is approximately equal to the supply pressure.

The auxiliary annular chamber 15 is kept airtight by virtue of the contact between the ring 14 and the stepped sleeve 11, the air pressure in said chamber being lower than that of the supply. To provide an airtight joint between the ring 14 and the stepped sleeve 11, it is desirable that the ring 14 be made of an elastic material, for example, rubber, and the mating surfaces of the ring and sleeve be tapered, a tight joint being ensured in virtue of elastic deformation of the ring.

The force exerted by the air pressure in the annular chamber 12 acts towards the front end of the body 1. This force and the action of the spring 16 hold the stepped sleeve 11 in the extreme forward position.

The reversal of the ground perforating device is effected by pulling the hose 17 (FIG. 2) whereby the spring 16 is compressed and the stepped sleeve 11 is moved all the way back until the end of the large-diameter portion thereof comes up against the inside end of the large-diameter portion of the stepped barrel 6. With the stepped sleeve 11 in this position, the hole 13 provided therein is closed by the inside wall of the small-diameter portion of the stepped barrel 6. A clearance space becomes formed between the front end of the stepped barrel 6 and the ring 14 whereby the auxiliary annular chamber 15 is put in communication with the source of compressed air. The port 9 in the large-diameter portion of the stepped barrel 6 is opened and put in communication with the auxiliary annular chamber 15.

Figure 2:
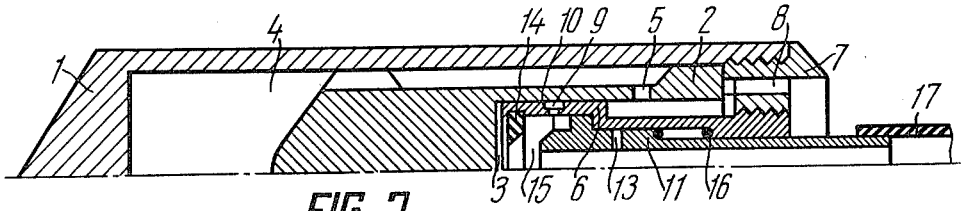
FIG. 2 is a longitudinal sectional view of the same, the parts being shown in their relative positions during reverse movement of the device.

FIG. 2 shows the hammer 2 in the rearmost position during reverse movement of the ground perforating device.

The compressed air fed through the hose 17 into the rear chamber 3 and the auxiliary annular chamber 15 exerts pressure on the stepped sleeve 11 and thereby retains it in position as long as the ground perforating device operates in the mode of reverse movement. At the same time the compressed air contained in the rear chamber 3 acts on the rear end of the hammer 2, causing the hammer 2 to move towards the front end of the body 1. When the hammer ports 5 connect with the circular groove 10 in the large-diameter portion of the barrel 6, the compressed air passes from the auxiliary annular chamber 15 through the port 9 and groove 10 into the front chamber 4.

Inasmuch as the area of the end face of the hammer 2 subjected to air pressure in the front chamber 4 is larger than the area of the hammer end face subjected to air pressure in the rear chamber 3, the force exerted on the hammer 2 in the front chamber 4 is greater than that in the rear chamber 3, said difference between the forces causing retardation of the hammer 2.

As the hammer 2 moves forward, the ports 5 provided therein become closed by the walls of the stepped barrel 6 and the volume of the front chamber 4 decreases, the air pressure therein rising, the force exerted on the front end of the hammer 2 still increasing. As a result, the hammer 2 stops and then starts moving back. At the end of the backward stroke the hammer 2 strikes the end of the body 1, more particularly, the nut 7. By the action of the backward blows the ground perforating device moves in reverse, out of the perforation. When the port 5 in the hammer 2 has gone past the edge of the large-diameter portion of the stepped barrel 6, the compressed air exhausts from the front chamber 4 into the atmosphere. The compressed air in the rear chamber 3 forces the hammer 2 to move forward and the cycle commences over again.

Changeover from reverse movement of the ground perforating device to forward movement thereof is effected by shutting off the compressed air supply. With the compressed air shut off, the spring 16 moves the stepped sleeve 11 into the forward position. When air feed is recommenced, the ground perforating device operates in the mode of forward movement.

Figure 3:
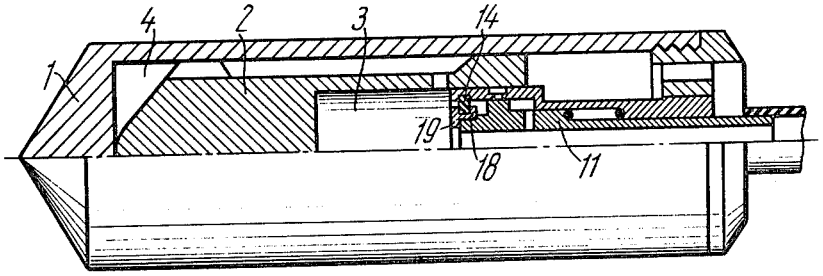
FIG. 3 is a longitudinal sectional view of the same, showing the embodiment wherein an interposed rigid ring is employed.

FIG. 3 shows another embodiment of the ground perforating device. In this embodiment, a ring 18 is fitted on the ring 14 to mate with the stepped sleeve 11. The ring 18 is made of a rigid material, for example, metal and has an internal circular shoulder 19 for the stepped sleeve 11 to bear upon. The operating principle of this embodiment of the ground perforating device is analogous to that described above. The use of the rigid-material ring 18 increases the life of the contacting surfaces of the parts concerned.

Figure 4:
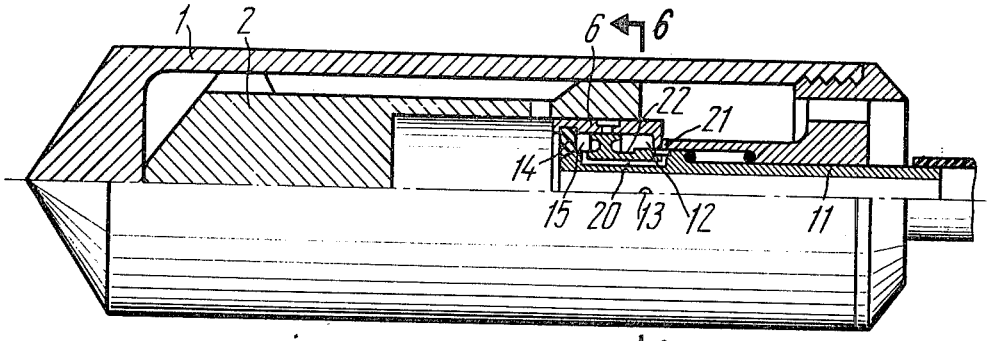
FIG. 4 is a longitudinal sectional view of the embodiment of the invention wherein the stepped sleeve is provided with passages, the parts being shown in their relative positions during forward movement of the ground perforating device.

FIG. 4 shows a further embodiment of the ground perforating device. In this embodiment, passages 20 and 21 are provided in the stepped sleeve 11 and the stepped barrel 6 respectively for the purpose of connecting the auxiliary annular chamber 15 with the atmosphere during forward movement of the ground perforating device.

The principle of air distribution and operation of the device in the modes of forward and reverse movement remains analogous to that described above. The passages 20 and 21 provide for exhausting into the atmosphere the compressed air which finds way into the auxiliary annular chamber 15 through clearance spaces between the contacting surfaces. Therefore, with the stepped sleeve 11 in the extreme forward position for the ground perforating device to operate in the mode of forward movement, the pressure in the auxiliary annular chamber 15 is equal to the atmospheric pressure, the passages 20 in the stepped sleeve 11 being in communication with the passages 21 in the stepped barrel 6.

Inasmuch as the annular chamber 12 communicates with the source of compressed air through the hole in the stepped sleeve 11, the pressure in said chamber is equal to the supply pressure. In consequence, the pressure exerted by the compressed air in the annular chamber 12 forces the stepped sleeve 11 against the ring 14.

This expedient increases the operating dependability of the ground perforating device since whenever compressed air gets into the auxiliary annular chamber 15 it is exhausted into the atmosphere through the passages 20 and 21, precluding the possibility of pressure rise in said chamber.

Figure 5:
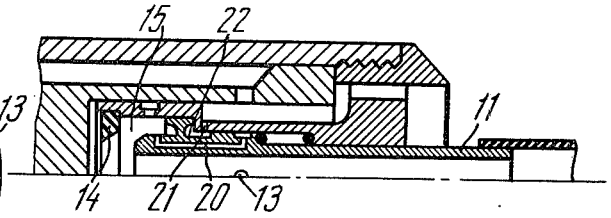
FIG. 5 is a longitudinal sectional view of the same embodiment of the invention, the parts being shown in their relative positions during reverse movement of the ground perforating device.

For the ground perforating device to operate in the mode of reverse movement, the stepped sleeve 11 takes the rearmost position where one of the outlets from the passage 20 is closed by the inner walls of the small-diameter portion of the stepped barrel 6, due to which the auxiliary annular chamber 15 is out of communication with the atmosphere (FIG. 5).

Figure 6:
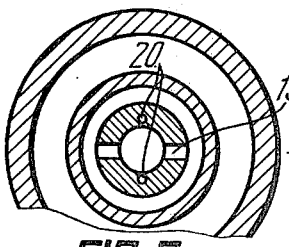
FIG. 6 is a sectional view taken on the section line 6—6 of FIG. 4.

The cross-sectional view of the ground perforating device in FIG. 6 shows the relative positions of the hole 13 and the passage 20 in the stepped sleeve 11.

A circular groove 22 (FIGS. 4, 5) may be provided on the small-diameter portion of the stepped sleeve 11 immediately behind the large-diameter portion thereof on the side facing the end of the body 1.

When the ground perforating device operates in the mode of forward movement, the circular groove 22 is located in the annular chamber 12 and has no effect on the operation of the ground perforating device.

When the ground perforating device operates in the mode of reverse movement, the stepped sleeve 11 being in the rearmost position, the circular groove 22 coincides with the passage 21 in the stepped barrel 6 whereby the annular chamber 12 is connected to the atmosphere and the atmospheric pressure is maintained therein. The compressed air which finds way into the annular chamber 12 through clearance spaces between the mating surfaces of the stepped sleeve 11 and the stepped barrel 6 is exhausted into the atmosphere through the circular groove 22 and the passage 21 in the stepped barrel 6.

This expedient increases the operating dependability of the ground perforating device during reverse movement thereof by virtue of increased force retaining the stepped sleeve 11 in the rearmost position.

Figure 9:
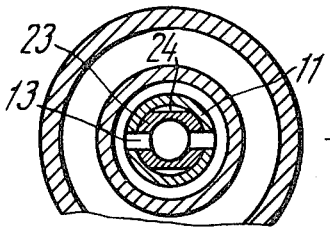
FIG. 9 is a sectional view on the section line 9—9 of FIG. 7.

A still further embodiment of the invention is possible wherein the stepped sleeve 11 (FIGS. 7, 8, 9) is of builtup construction. An insert 23 is installed inside the stepped sleeve 11 at the side thereof facing the hammer 2 so that a passage 24 is formed between the outer surface of said insert and the inner surface of said stepped sleeve, said passage connecting the auxiliary annular chamber 15 with the atmosphere. Two circular grooves 25 and 26 are provided on the outside of the insert 23 so that, with the insert 23 turned, the longitudinal portion of the passage 24 is always is communication with the radial portions thereof. The insert 23 is rigidly secured in the stepped sleeve 11, for example, by screwing or pressure-in. FIG. 9 shows the relative positions of the passage 24 and the hole 13 in the stepped sleeve 11.

Figure 7:
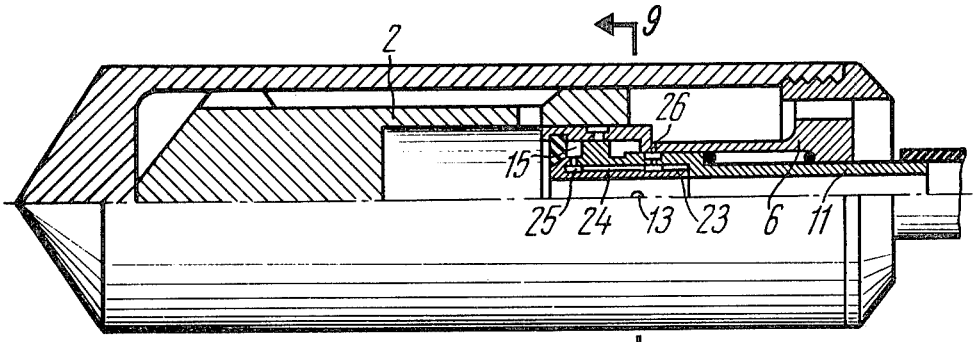
FIG. 7 is a longitudinal sectional view of the embodiment of the invention wherein an insert is provided, the parts being shown in their relative positions during forward movement of the ground perforating device.
Figure 8:
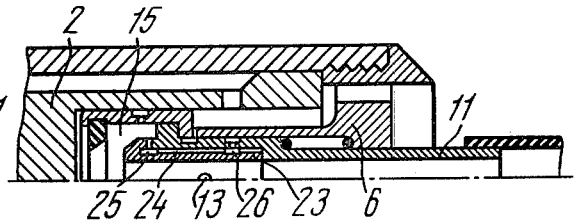
FIG. 8 is a longitudinal sectional view of the same embodiment of the invention, the parts being shown in their relative positions during reverse movement of the ground perforating device.

When the ground perforating device operates in the mode of forward movement as shown in FIG. 7, the stepped sleeve 11 is in the extreme forward position and the insert 23 fits against the ring 14, thereby rendering the auxiliary annular chamber 15 airtight. The compressed air which finds way into the auxiliary annular chamber 15 is exhausted into the atmosphere through the passage 24 and the ports 13 in the stepped barrel 6.

When the ground perforating device operates in the mode of reverse movement (FIG. 8), the stepped sleeve 11 is in the rearmost position and one of the outlets from the passage 24 is closed by the walls of the stepped barrel 6, whereby the auxiliary annular chamber 15 is put out of communication with the atmosphere.

The cross-sectional view of the ground perforating device in FIG. 9 shows the relative positions of the passage 24 and the hole 13 in the stepped sleeve 11. The operating principle of this embodiment of the invention is analogous to that described above. Said embodiment simplifies the manufacture of the passage connecting the auxiliary annular chamber 15 with the atmosphere.

Figure 10:
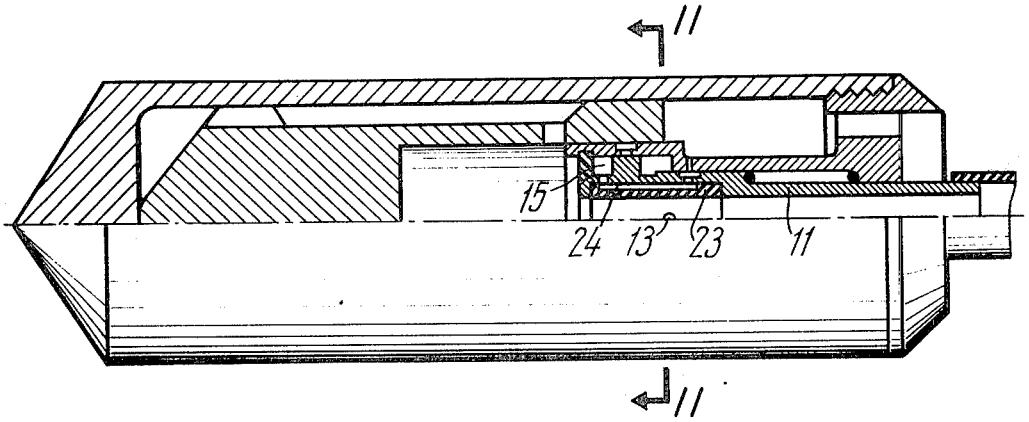
FIG. 10 is a longitudinal sectional view of the embodiment of the invention wherein an elastic insert is provided, the parts being shown in their relative positions during forward movement of the ground perforating device.

FIG. 10 shows a still further embodiment of the ground perforating device. In this embodiment, the insert 23 is made of an elastic material, for example, rubber. The passage 24 formed between the outer surface of the insert 23 and the inner surface of the stepped sleeve 11 connects the auxiliary annular chamber 15 with the atmosphere during forward movement of the ground perforating device.

Figure 11:
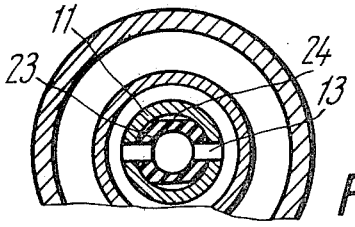
FIG. 11 is a sectional view on the section line 11—11 of FIG. 10.

The cross-sectional view of the ground perforating device in FIG. 11 shows the relative positions of the passage 24 and the holes 13 in the stepped sleeve 11. The operating principle of this embodiment is analogous to that described above.

What is claimed is:

1. A reversible percussive device comprising, a hollow cylindrical body, an impact hammer reciprocable in said body intermittently impacting a forward end portion of said body for percussive driving of said body, said hammer having a front end defining jointly with said body a front power chamber variable in volume as said hammer reciprocates, said hammer having a rear hollow defining a rear power chamber varying in volume as said hammer reciprocates, a stepped cylindrical barrel with a stepped outside diameter with a major diameter portion extending axially into said hollow and relative to which said hammer reciprocates, means securing said barrel adjacent a rear end of said body, a stepped inner sleeve slidable internally of said barrel coaxial therewith having a major diameter portion in registry with the major diameter portion of said barrel defining a chamber in conjunction with said inner sleeve and in communication with said hollow defining said rear power chamber, said hammer having an axial passageway and a port providing communication between the front power chamber and the rear power chamber when the hammer is in a forward position and providing communication only to atmosphere when the hammer reciprocates to a rear position, the hammer having a greater area upon which gas under pressure in said front chamber acts than an area on which gas under pressure in said rear chamber pressure acts, and said stepped barrel and said inner sleeve having ports and passages effective to continuously supply gas under pressure to said rear chamber for driving the hammer rearwardly when said hammer is in a forward position, whereby gas under pressure is exhausted as said hammer reaches said rearward position and gas under pressure drives said hammer forwardly to impact said front end of said body.

2. A reversible percussive device according to claim 1, in which said hollow body has a pointed front end.

3. A reversible percussive device according to claim 1, including a spring constantly biasing said inner sleeve axially in a forward direction.

* * * * *